US010092099B1

(12) United States Patent
Linari et al.

(10) Patent No.: US 10,092,099 B1
(45) Date of Patent: Oct. 9, 2018

(54) ADJUSTABLE SHELVING

(71) Applicants: Ronald Linari, Mansfield, MA (US); Gary Tremblay, East Bridgewater, MA (US)

(72) Inventors: Ronald Linari, Mansfield, MA (US); Gary Tremblay, East Bridgewater, MA (US)

( * ) Notice: Subject to any disclaimer, the term of this patent is extended or adjusted under 35 U.S.C. 154(b) by 38 days.

(21) Appl. No.: 15/704,652

(22) Filed: Sep. 14, 2017

(51) Int. Cl.

| | |
|---|---|
| ***A47B 47/00*** | (2006.01) |
| ***A47B 87/00*** | (2006.01) |
| ***A47B 96/02*** | (2006.01) |
| ***A47B 87/02*** | (2006.01) |
| ***A47B 61/04*** | (2006.01) |
| ***A47B 57/48*** | (2006.01) |
| ***A47B 45/00*** | (2006.01) |

(52) U.S. Cl.
CPC ..... *A47B 87/0223* (2013.01); *A47B 45/00* (2013.01); *A47B 47/00* (2013.01); *A47B 57/48* (2013.01); *A47B 61/04* (2013.01)

(58) Field of Classification Search
CPC ..... A47B 45/00; A47B 47/00; A47B 87/0223; A47B 87/02; A47B 87/0246; A47B 87/005
See application file for complete search history.

(56) References Cited

U.S. PATENT DOCUMENTS

| | | | | | |
|---|---|---|---|---|---|
| 7,789 | A | * | 11/1850 | Shoeberger | A47B 1/08 108/93 |
| 387,267 | A | * | 8/1888 | Talbot | A47B 63/00 108/190 |
| 908,392 | A | | 12/1908 | Casteel | |
| 2,431,423 | A | | 11/1947 | Robbins | |
| 2,696,246 | A | * | 12/1954 | Putnam | B60N 2/2854 108/129 |
| 3,760,744 | A | * | 9/1973 | Cruckshank | A47B 1/08 108/102 |
| 4,168,871 | A | | 9/1979 | Dierkes | |
| 4,321,873 | A | * | 3/1982 | Nealis | A47B 87/005 108/101 |
| 4,915,238 | A | | 4/1990 | Cassel | |
| 5,065,871 | A | | 11/1991 | Chan | |
| 5,158,187 | A | * | 10/1992 | Taub | A47B 87/0223 108/185 |
| 5,283,996 | A | * | 2/1994 | Myers | B28B 23/04 249/83 |
| 5,400,719 | A | * | 3/1995 | Santapa | A47B 87/0223 108/182 |
| 5,579,702 | A | * | 12/1996 | Aho | A47B 87/008 108/91 |
| 5,617,959 | A | | 4/1997 | Klein et al. | |

(Continued)

*Primary Examiner* — Kimberley S Wright
(74) *Attorney, Agent, or Firm* — Salter & Michaelson

(57) ABSTRACT

A rack for supporting items and comprising a first shelf and a second shelf that slideably interlocks with the first shelf and a plurality of support legs including at least two support legs for each of the first shelf and second shelf. Each of the first and second shelves has one end that includes a pair of spaced apart receiving ports with each receiving port for accommodating a corresponding support leg. Each of the first and second shelves further has an opposite end with the opposite ends for respective sliding engagement therebetween in order to provide the slideable interlocking.

8 Claims, 16 Drawing Sheets

(56) References Cited

U.S. PATENT DOCUMENTS

| | | | | | |
|---|---|---|---|---|---|
| 5,722,544 | A * | 3/1998 | Williams | A47B 87/008 | 108/107 |
| 5,746,139 | A * | 5/1998 | Villanueva | A47B 45/00 | 108/102 |
| D424,320 | S | 5/2000 | Klein et al. | | |
| 6,142,321 | A * | 11/2000 | West | A47B 45/00 | 108/143 |
| 6,332,548 | B1 * | 12/2001 | West | A47B 45/00 | 211/175 |
| 6,877,826 | B2 * | 4/2005 | Wood | A47B 45/00 | 108/110 |
| 6,920,834 | B1 * | 7/2005 | Pehta | A47B 9/14 | 108/147.21 |
| 6,942,269 | B2 * | 9/2005 | Mains | B60N 3/001 | 108/44 |
| 6,988,628 | B2 * | 1/2006 | Krieger | A47B 45/00 | 211/86.01 |
| 7,765,940 | B1 * | 8/2010 | Peterson | A47B 9/00 | 108/144.11 |
| 7,770,743 | B1 * | 8/2010 | Janowak | A47G 7/042 | 108/92 |
| 8,215,498 | B2 | 7/2012 | Rathbone et al. | | |
| 9,370,241 | B1 * | 6/2016 | Dilmaghani | A47B 13/003 | |
| 9,706,839 | B2 * | 7/2017 | Dilmaghani | A47B 87/002 | |
| 2003/0075083 | A1 * | 4/2003 | Devey | A47B 87/0246 | 108/92 |
| 2009/0071380 | A1 * | 3/2009 | Chen | A01K 13/00 | 108/12 |
| 2015/0083027 | A1 * | 3/2015 | Martin | A47B 9/18 | 108/1 |
| 2016/0214763 | A1 * | 7/2016 | Morin | B65D 21/0204 | |
| 2016/0255956 | A1 * | 9/2016 | Dilmaghani | A47B 87/002 | |

* cited by examiner

ADJUSTABLE SHELVING

FIELD OF THE INVENTION

The present invention relates in general to a rack for supporting items, and in particular, a rack that is adjustable. The present invention also relates to a shoe rack that employs separate shelf members that can be slidably interlocked in combination with legs for the shelf members. Even more particularly, the present invention relates to a rack structure that is easy to assemble, that is adjustable at least in height and length, and that is stackable.

BACKGROUND OF THE INVENTION

There are various forms of rack structures in the prior art. The rack structure of the present invention is meant primarily for use as a shoe rack. However, it can also be used for the storage of other items. In connection with existing shoe racks, examples can be found in U.S. Pat. No. 4,915,238 to Castle and U.S. Pat. No. 5,065,871 to Chan. Most of these rack structures are relatively complex in construction and, in particular, for a shoe rack, require complex wire forms and configurations.

Accordingly, it is an object of the present invention to provide an improved rack structure that is of simplified construction and that employs first and second shelves that slidably engage along with a plurality of support legs for supporting these shelves.

Another object of the present invention is to provide an improved rack structure that is easy to assemble, that is adjustable at least in height and length, and that is stackable.

SUMMARY OF THE INVENTION

To accomplish the foregoing and other objects, features and advantages of the present invention there is provided a rack for supporting items and comprising a first shelf and a second shelf that slideably interlocks with the first shelf and a plurality of support legs including at least two support legs for each of the first shelf and second shelf. Each of the first and second shelves has one end that includes a pair of spaced apart receiving ports with each receiving port for accommodating a corresponding support leg. Each of the first and second shelves further has an opposite end with the opposite ends for respective sliding engagement therebetween in order to provide the slideable interlocking.

In accordance with other aspects of the present invention each shelf has a flat planar middle portion and opposite side portion; each opposite side portion has a c-shaped cross-section; the first shelf is wider than the second shelf in order to accommodate an engagement and sliding between the shelves; each receiving port is at a corner of the shelf and is sized to receive a top of the support leg; each receiving port is at a corner of the shelf and is sized to receive a top of the support leg; each receiving port includes a web that is disposed across the receiving port and upon which a top of the support leg rests; wherein the receiving port is circular, the web is circular and the web is secured within the receiving port to provide an open top port section that is of less height than an open bottom port section; wherein each support leg is comprised of an outer tube and an inner tube that is slideable relative to, concentric, and disposed within the outer tube; wherein the outer tube has a series of holes spacedly disposed along a length of the outer tube, and the inner tube supports a locking button for engagement with any one of the holes in order to adjust the height of the leg;

wherein each of the first and second shelves has spaced apart support corners, and the plurality of legs comprise four legs, one engaged with a receiving port that is disposed at each corner of the respective first and second shelves; wherein the first and second shelves have a closed position wherein a total length of the first and second shelves is at a minimum length and an open position wherein the total length of the first and second shelves is longer than the minimum length; including at least a fifth leg for support of the first and second shelves at a location between the shelf corners; including fifth and sixth legs for support of the first and second shelves at a location between the shelf corners; wherein the second shelf has a through hole for receiving a top end of the fifth leg, or wherein the second shelf has a pair of spaced apart through holes for receiving a top end of the respective fifth and sixth legs; including spaced apart holes that extend longitudinally of the second shelf so as to be able to support the first and second shelves at different extended positions therebetween.

In accordance with another version of the present invention here is provided a shoe rack comprising:

a first shelf;

a second shelf that slideably interlocks with the first shelf;

a plurality of support legs including at least two support legs for each of the first shelf and second shelf;

each said first and second shelves having one end that includes a pair of spaced apart receiving ports with each receiving port for accommodating a corresponding support leg therein;

each said first and second shelves further having an opposite end that is leg-free and open so as to be able to have the slideable interlock between the respective first and second shelves;

each shelf having a planar middle portion and opposite side portion with each opposite side portion having a c-shaped cross-section;

said first shelf being wider than the second shelf in order to accommodate an engagement and sliding between the shelves;

each receiving port being disposed at a corner of the shelf and being sized to receive a top of the support leg;

each support leg being comprised of an outer tube and an inner tube that is slideable relative to, concentric with, and disposed within the outer tube;

each of the first and second shelves having spaced apart support corners, and the plurality of legs comprise four legs, one engaged with the receiving port that is disposed at each corner of the respective first and second shelves;

the first and second shelves having a closed position wherein a total length of the first and second shelves is at a minimum length and an extended position wherein the total length of the first and second shelves is longer than the minimum length;

fifth and sixth legs for support of the first and second shelves at a location between the shelf corners and when the shelves are in the extended position;

the second shelf having a pair of spaced apart through holes for receiving a top end of the respective fifth and sixth legs.

Additional aspects of the present invention are including a second set of shelves adapted to be disposed over the first and second shelves and a second set of legs for support of the second set of shelves over the first and second shelves, said first shelf having a blind recess for receiving a bottom end of a leg of the second set of legs, said recess overlying the hole in the second shelf; and having the second set of legs disposed inboard of the first and second shelves.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 11:
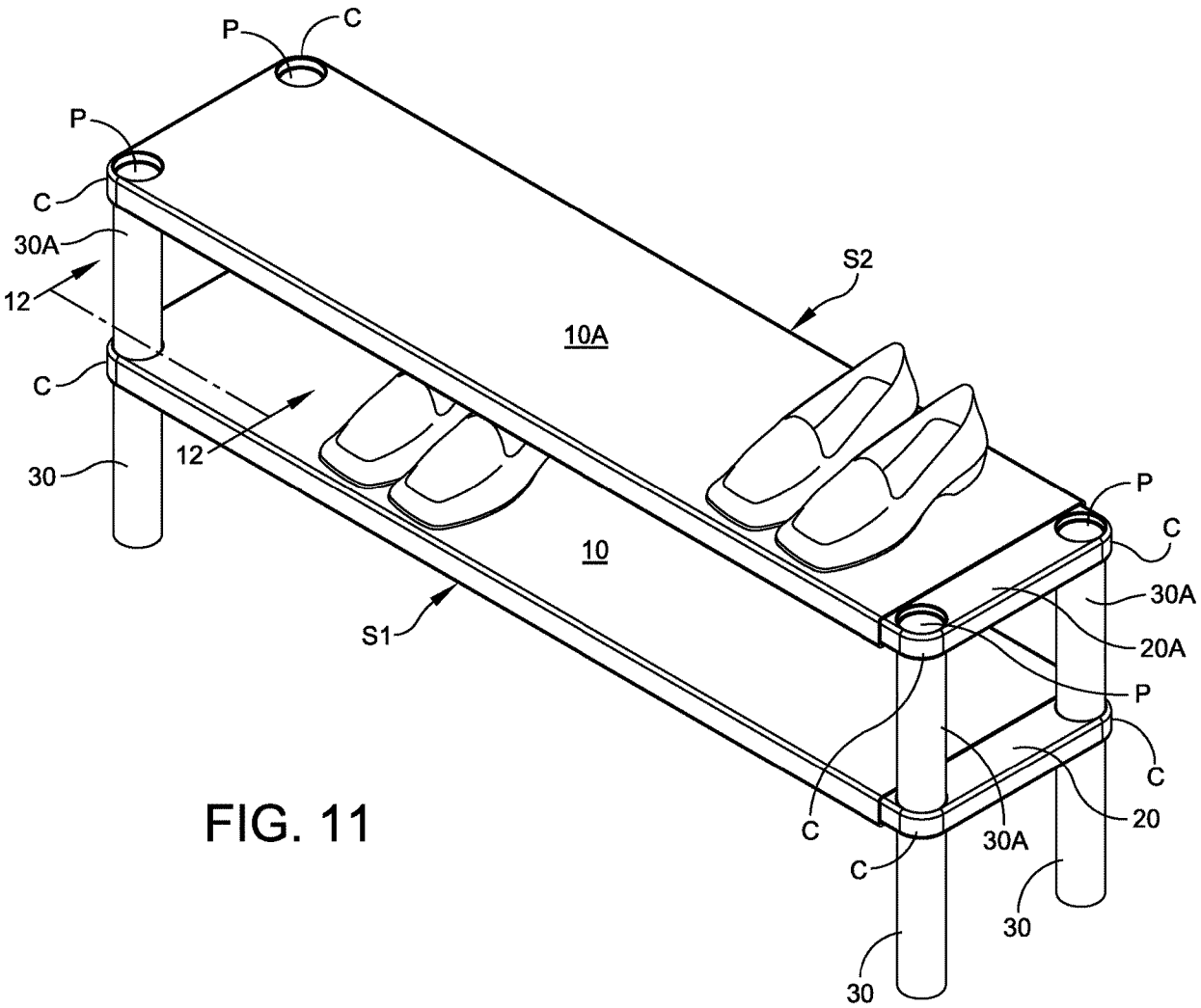
FIG. 11 is a perspective view illustrating two sets of shelving each with associated support legs and illustrated in a stacked manner.
Figure 12:
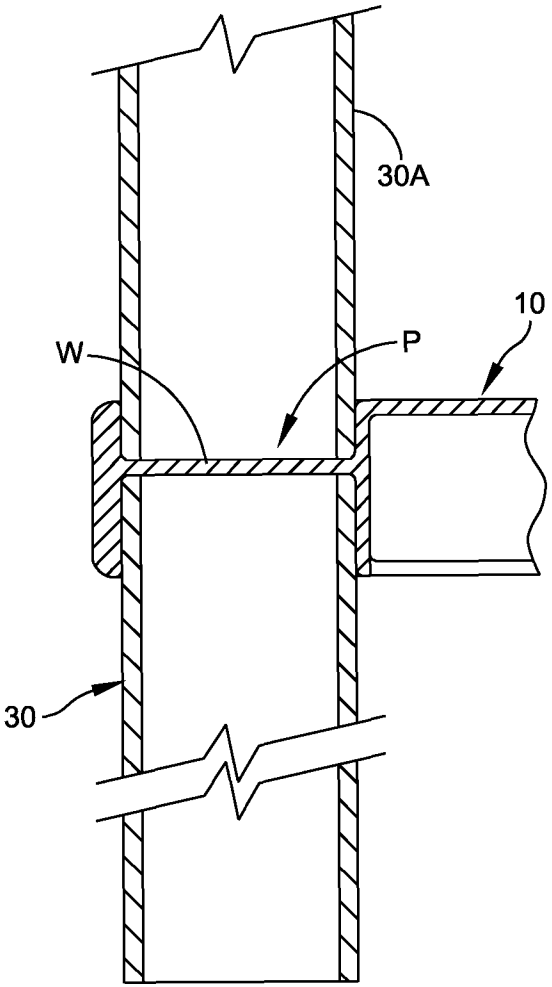
FIG. 12 is a cross-sectional view taken along line 12-12 of FIG. 11.
Figure 13:
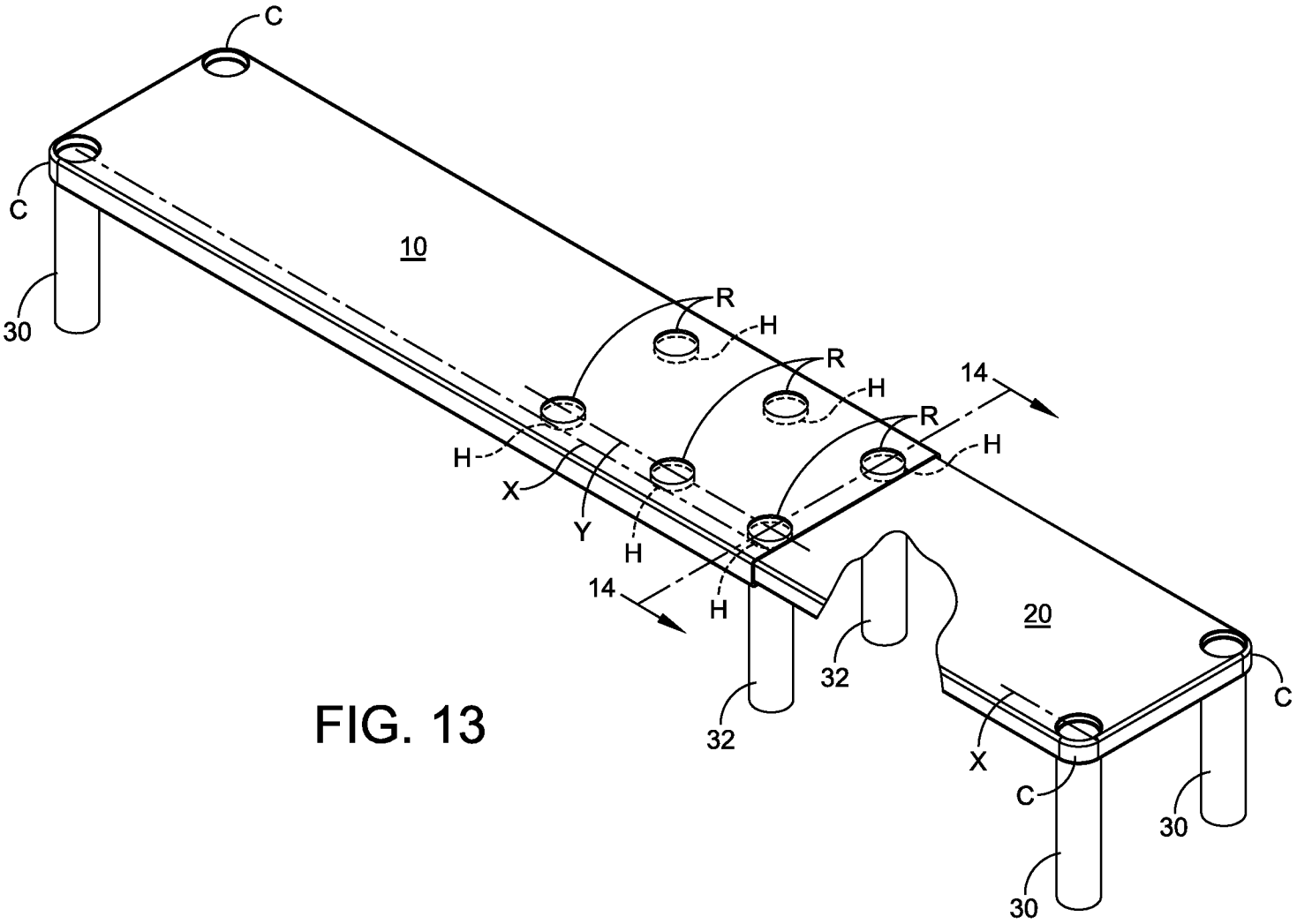
FIG. 13 illustrates another feature of the present invention employing middle support legs between end leg pairs.
Figure 14:
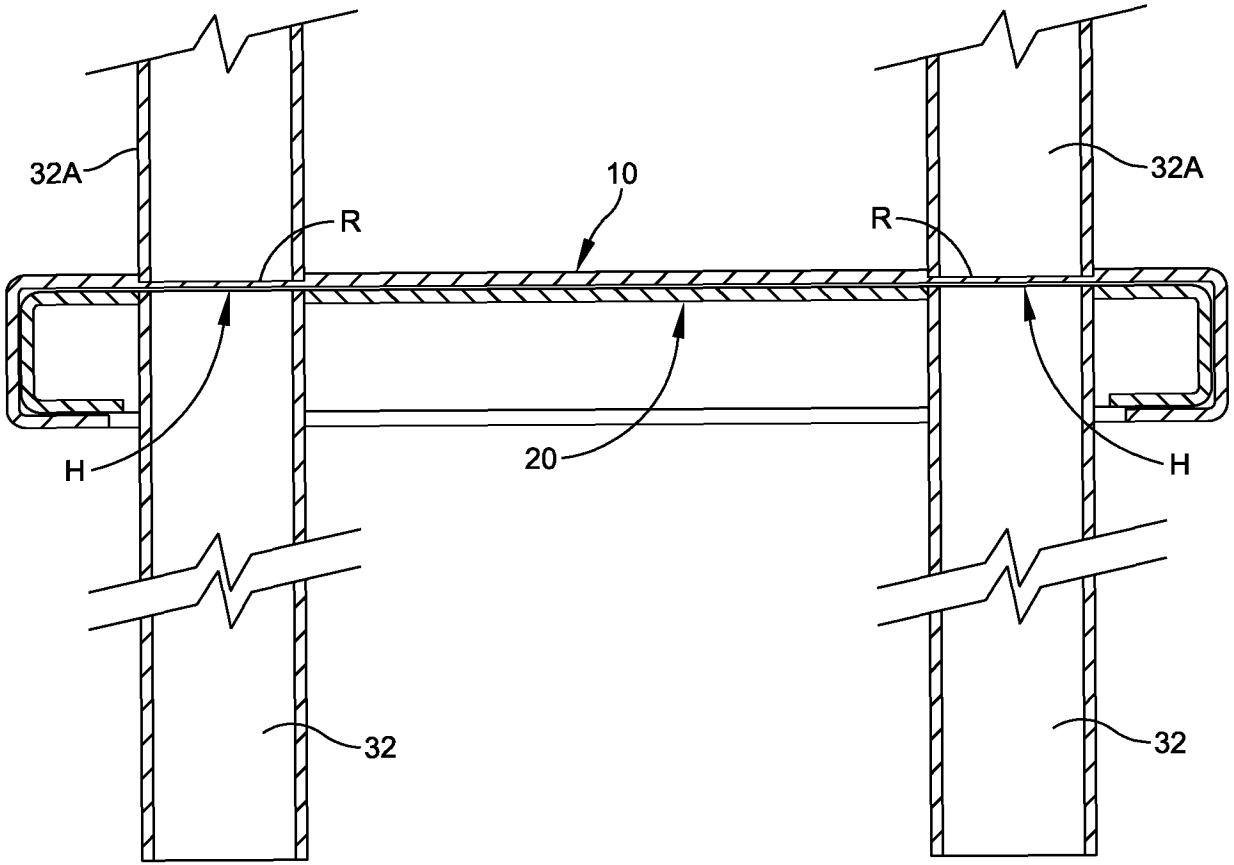
FIG. 14 is a cross-sectional view taken along line 14-14 of FIG. 13.
Figure 15:
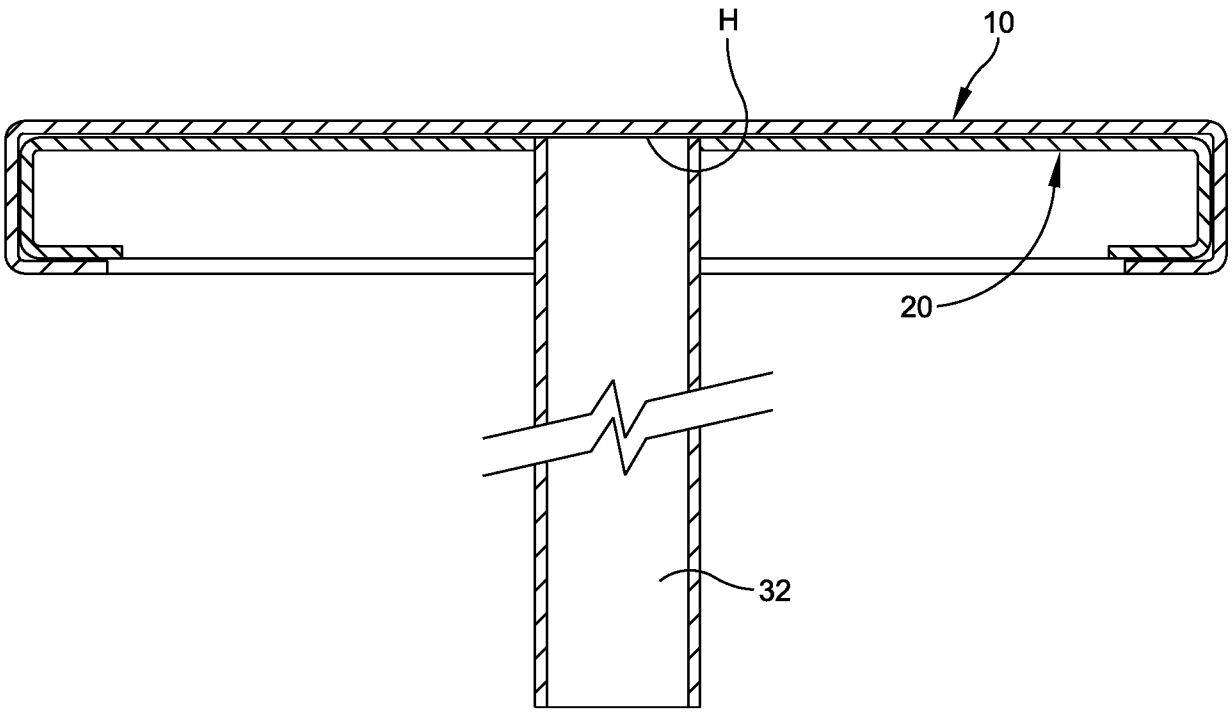
FIG. 15 is a cross-sectional view similar to that illustrated in FIG. 14 but showing only a single center support leg.

Reference is now made to a first embodiment of the present invention illustrated in FIGS. 1-10. A related embodiment is illustrated in FIGS. 11 and 12. FIGS. 11 and 12 describe the stacking concept of the present invention. FIGS. 13-15 illustrate another feature of the present invention that employs middle support legs. This is particularly advantageous when the two shelves are moved to an extended position, as illustrated in FIG. 13. Finally, FIGS. 16-21 illustrate the use of support legs that are adjustable in height.

With respect to FIGS. 1-10, the rack, which is for supporting various types of items including shoes, is comprised of a first shelf 10 and a second shelf 20 that slidably interlocks with the first shelf 10. These shelves are supported by means of a plurality of support legs 30. In the illustrated embodiment there are two support legs for each of the first and second shelves. Each of the shelves 10, 20 have one end that includes a pair of spaced apart receiving ports P with each receiving port for accommodating a corresponding support leg 30. Each of the shelves 10, 20 further have an opposite end for respective sliding engagement between the shelves in order to provide a slidable interlocking.

Figure 1:
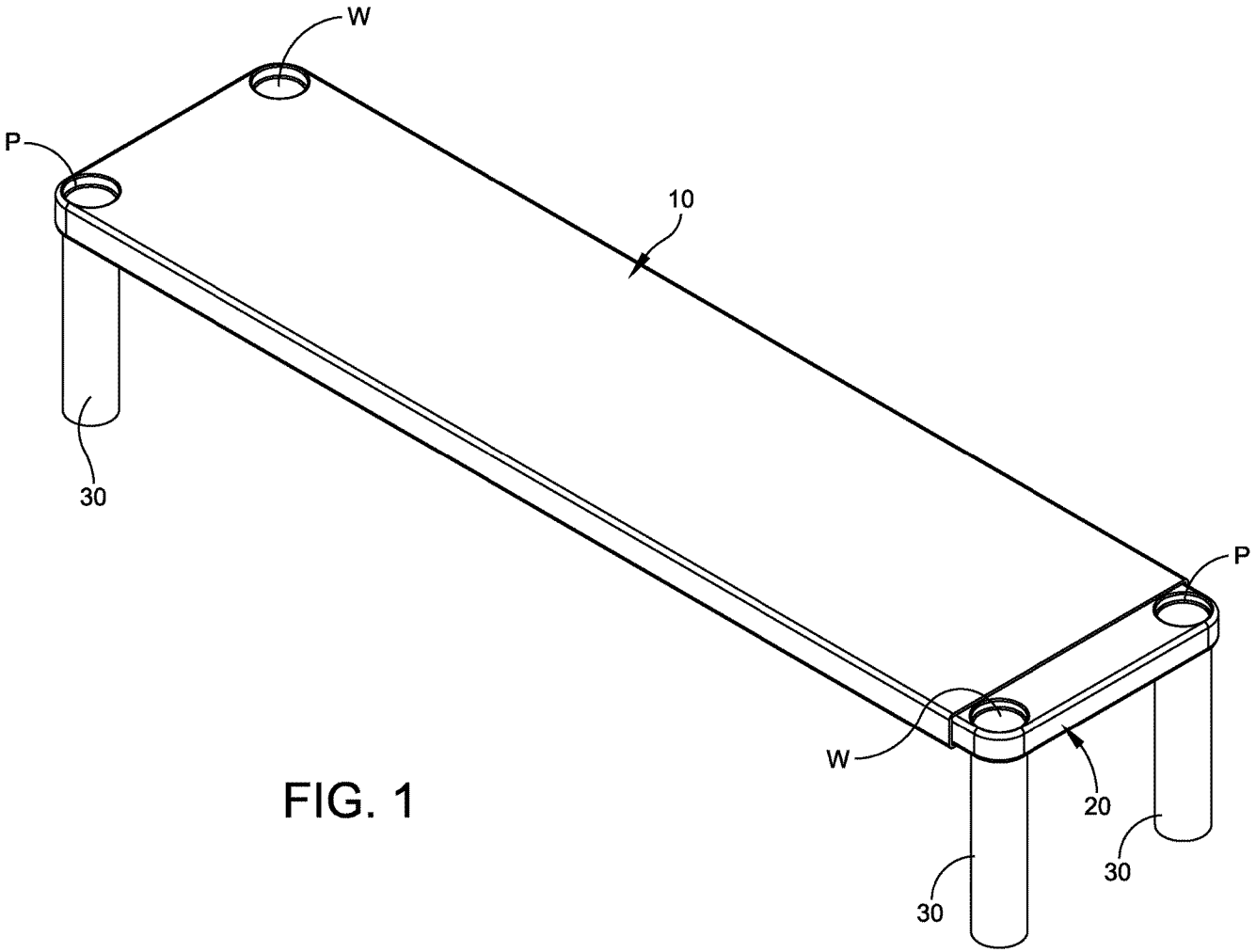
FIG. 1 is a perspective view of one embodiment of the present invention illustrating first and second shelves and associated support legs.
Figure 2:
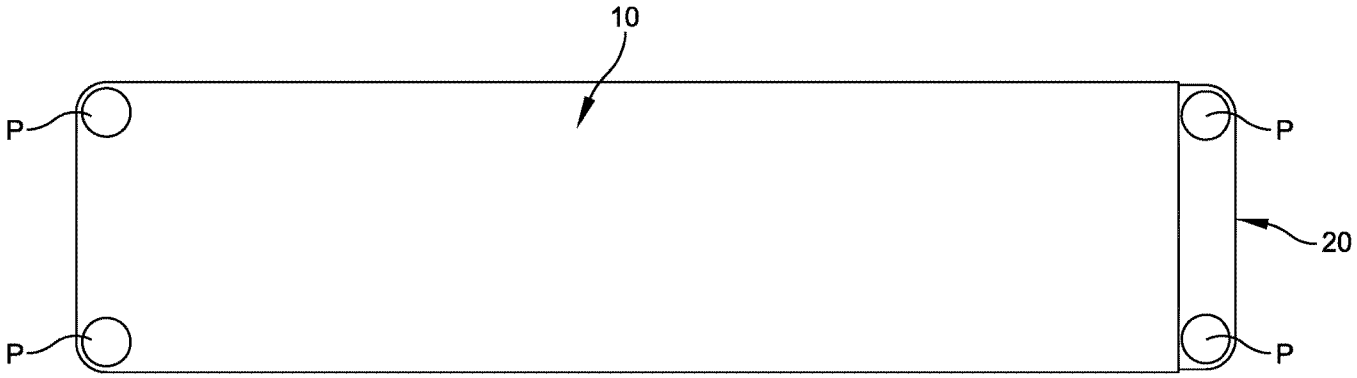
FIG. 2 is a plan view of the rack structure of FIG. 1.
Figure 3:
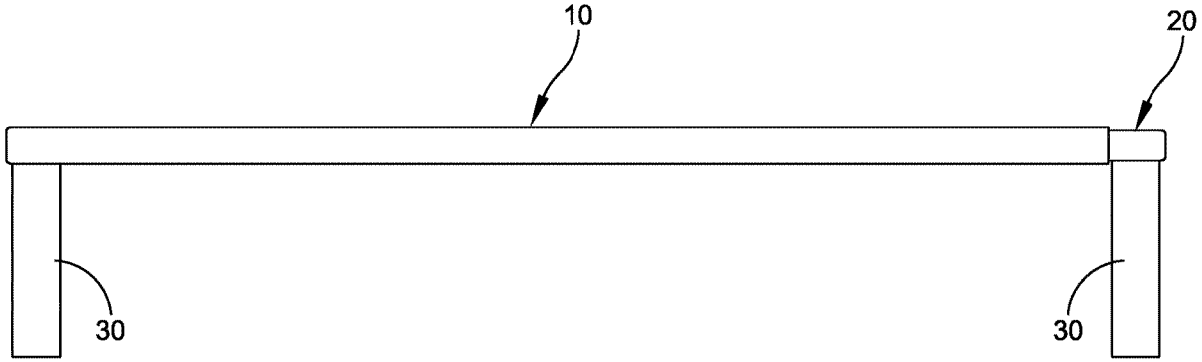
FIG. 3 is a side elevation view of the rack structure of FIG. 1.
Figure 4:
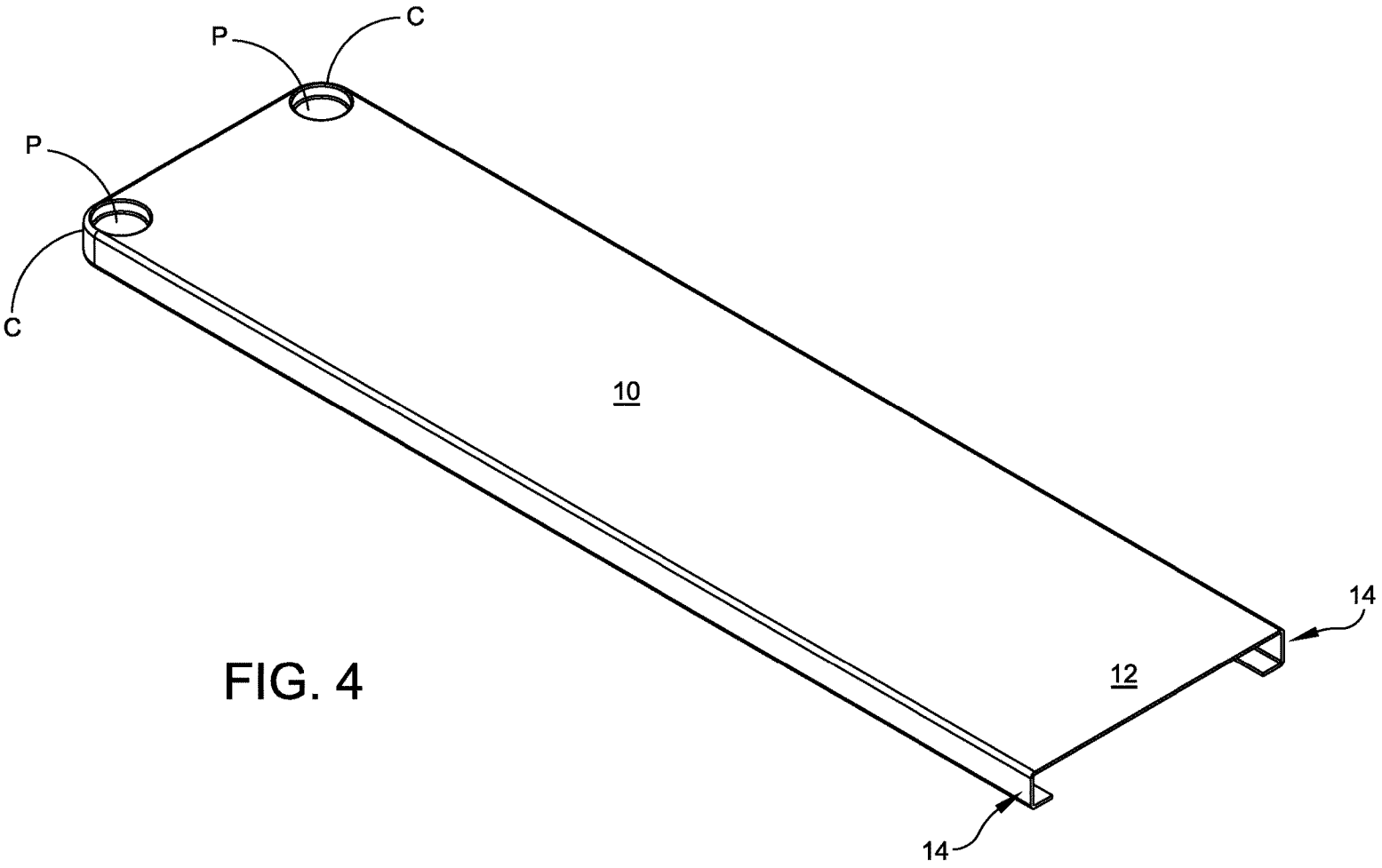
FIG. 4 is a perspective view of one of the shelves illustrated in FIG. 1.
Figure 9:
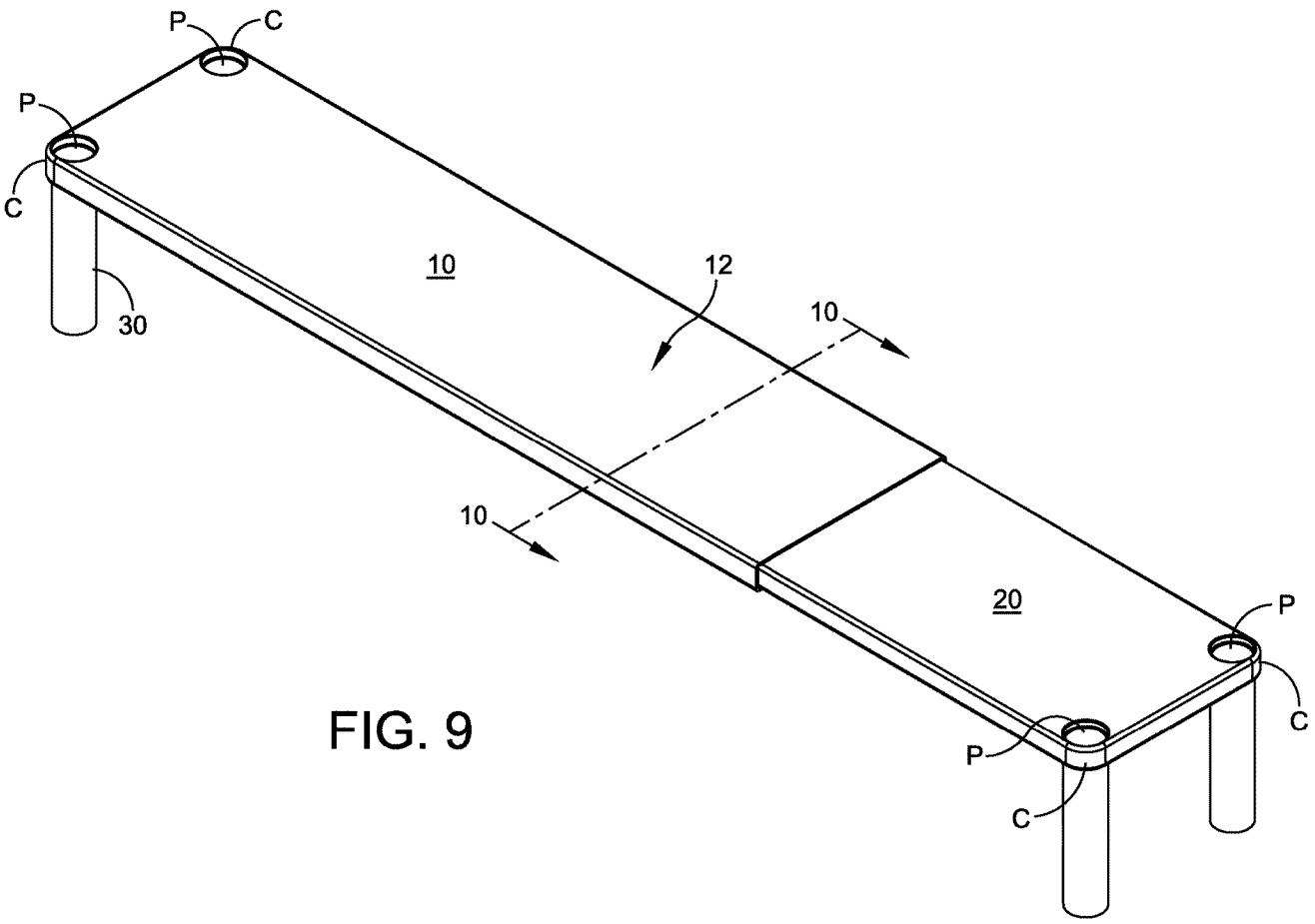
FIG. 9 is a perspective view of the embodiment illustrated in FIGS. 1-8 but with the second shelf extended so that the total length of the shelving is increased.
Figure 10:
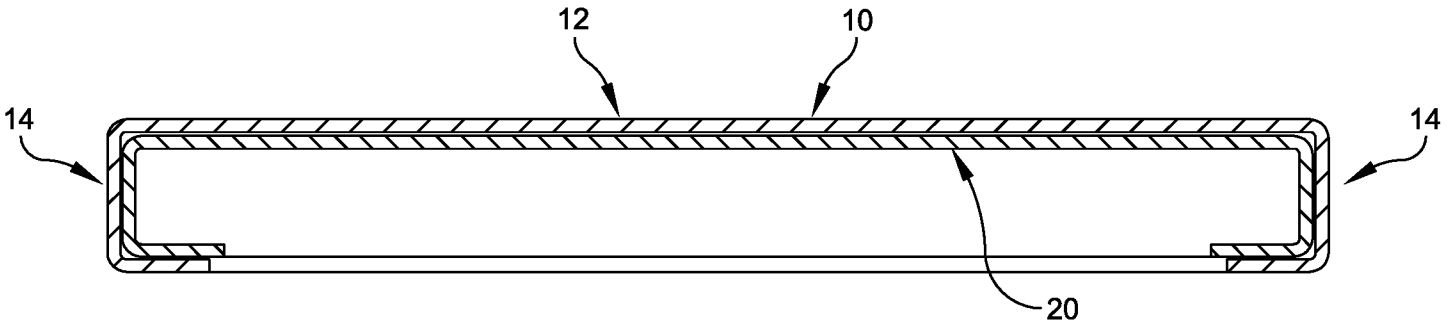
FIG. 10 is a cross-sectional view taken along line 10-10 of FIG. 9.

The cross-sectional view of FIG. 10 clearly indicates the interengagement between the shelves 10 and 20. Also, the perspective views of FIGS. 1 and 9 illustrate the engagement. While FIG. 1 illustrates the shelves in a fully closed position, FIG. 9 illustrates the shelves with the shelf 20 extended outwardly from the shelf 10 so as to provide an increased total shelf length. In the drawings, the configuration of the shelf 10 is shown completely. It is understood that the smaller shelf 20 has substantially an identical construction including the receiving ports P. Each of the shelves 10 and 20 has a flat planar middle portion 12, such as illustrated in FIG. 10, and opposite side portions 14. Each of the opposite side portions is in the form of a C-shape cross-section as illustrated in FIG. 10. The dimensions of the respective shelves 10, 20 are constructed so that they fit tightly within each other while still enabling a sliding action therebetween. In this regard, as illustrated in FIG. 10, the first shelf 10 is slightly wider than the second shelf 20.

Figure 5:
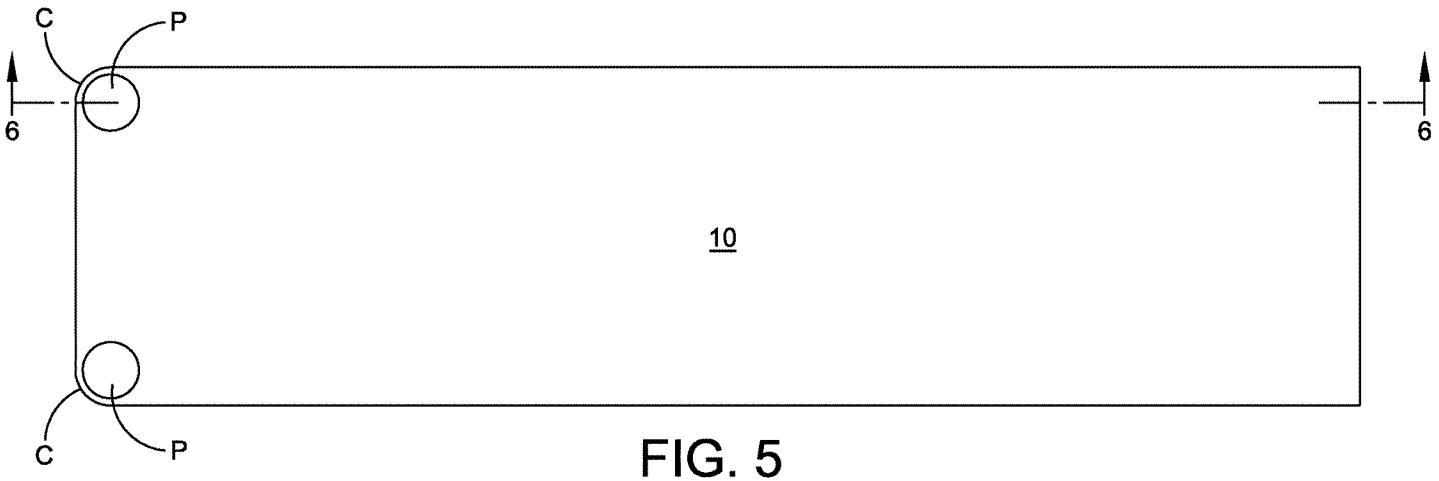
FIG. 5 is a plan view of the shelf of FIG. 4.
Figure 6:
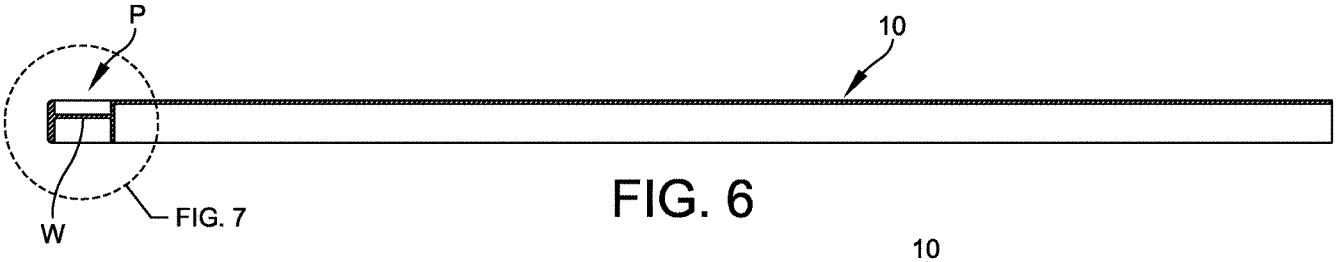
FIG. 6 is a cross-sectional view taken along line 6-6 of FIG. 5.
Figure 7:
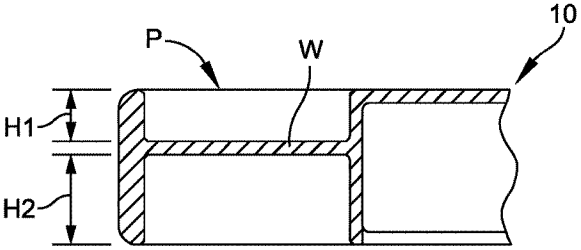
FIG. 7 is an enlarged cross-sectional view at the receiving port shown in dotted circular outline in FIG. 6.

For the construction of the receiving ports P, one may refer to FIGS. 1, 4 and 6-8. In particular, FIGS. 6 and 7 illustrate by a cross-sectional view, the construction of the port P. Each of the ports P are located at a corner C of the shelf FIG. 5 illustrates the corners C and the ports P associated with the first shelf 10. In this regard, reference may also be made to the cross-sectional view of FIG. 12 which actually shows legs engaged at the port P. Each of these ports has between its upper and lower ends a web W that is disposed across the receiving port and upon which a top of a support leg rests, such as illustrated in FIG. 12. By providing the web W in the location illustrated in FIG. 7, there is a port height H1 that is less than the port height H2. The height H2 enables a sufficient support area for the top of a leg 30. When the shelf sets are to be stacked, such as illustrated in FIGS. 11 and 12, there is still a sufficient height H1 to receive an overlying leg associated with the overlying shelf set. In the preferred embodiment the receiving port is circular and the web is also circular. The web W could also be replaced by other structures such as a spoke arrangement.

Figure 8:
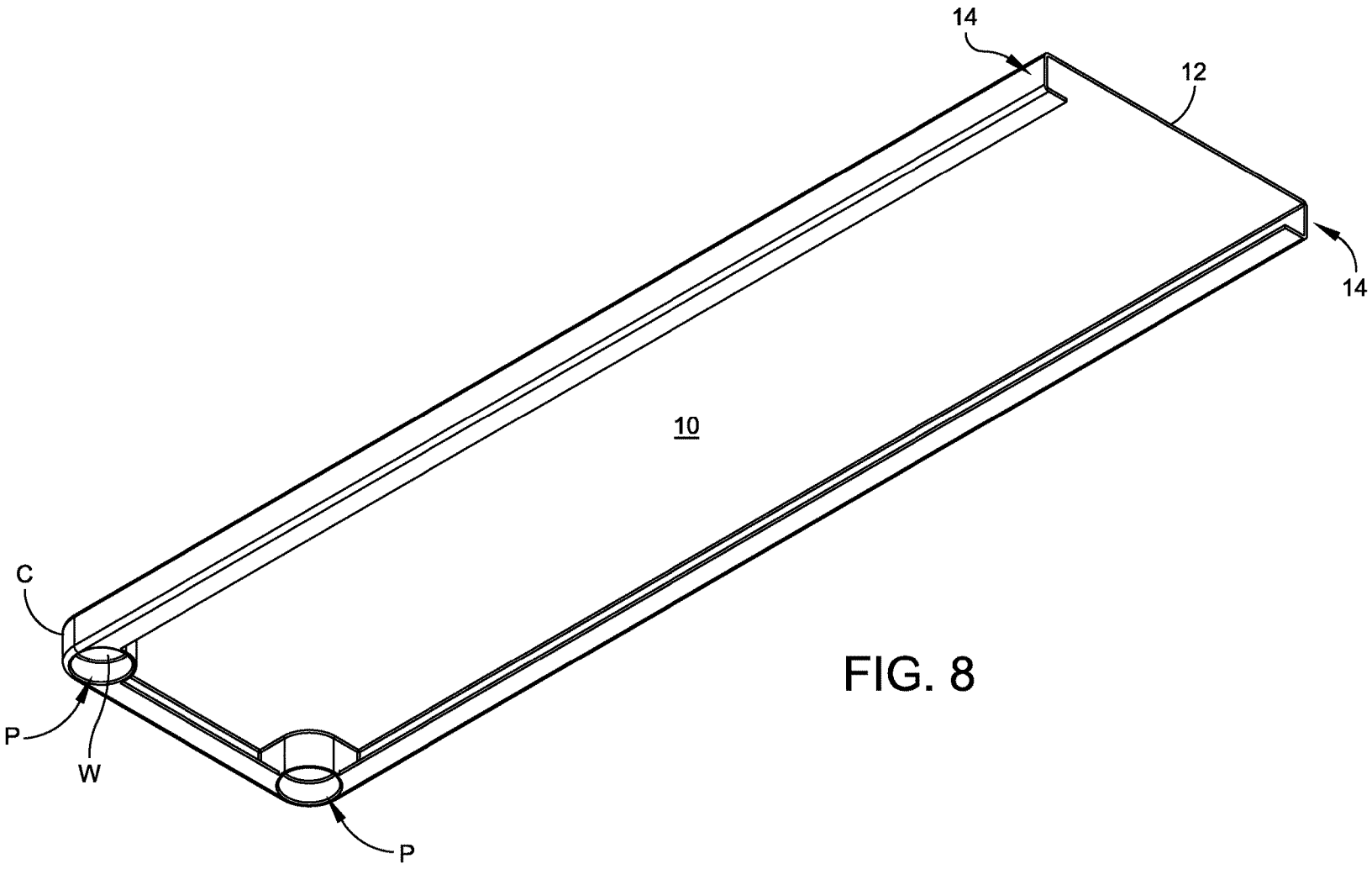
FIG. 8 is a bottom perspective view of the shelf shown in FIG. 4.

The bottom perspective view of FIG. 8 also illustrates the manner in which the middle portion 12 and the opposite side portions 14 extend along substantially the entire length of the shelf with the exception of the area at the corners C where the ports P are arranged. In this regard, the second shelf 20 may be slightly shorter in length than the shelf 10 so that when the shelf 20 is in its fully closed position as in FIG. 1 it does not interfere with the ports P of the shelf 10.

FIGS. 11 and 12 illustrate the stacking concepts of the present invention. FIG. 11 illustrates a first shelf set S1 and a second shelf set S2. Each of these shelve sets may be of substantially the same construction. Each being provided with four corner legs. This includes the corner legs 30 associated with the first shelf set S1 and the corner legs 30A associated with the second shelf set S2. FIG. 12 is a cross-sectional view taken along line 12-12 of FIG. 11 and illustrates the manner in which the respective legs 30 and 30A engage at the port P. The web W sits upon the top surface of the leg 30 while the bottom surface of the leg 30A sits on top of the web W.

Reference is now made to FIGS. 13-15 for an illustration of the use of additional support legs identified in FIG. 13 as a pair of legs 32 as an alternative to a pair of legs illustrated in FIGS. 13 and 14 there may also be provided a single leg 32, although, the preferred arrangement employs a pair of legs 32.

Refer now to the cross-sectional view of FIG. 14 which is taken along line 14-14 of FIG. 13. This illustrates the manner in which both the legs 32 as well as a possible overlying leg 32A engage with the second shelf 20. For this purpose, the second shelf has a pair of spaced apart holes H each for receiving a top end of the respective legs 32. In addition, over the hole H in the shelf 20, there is provided a recess R within the surface of the larger shelf 10. This recess R is for the positioning and securement of an overlying leg 32A in a stacking arrangement. Refer also to the perspective view of FIG. 13 which shows in dotted outline a series of holes H that extend, not only spaced apart as at the cross-section 14-14, but also spaced apart in pairs longitudinally so that the middle legs 32 can be engaged at different positions along the shelf 20 depending upon how far the shelf 20 is extended out of the shelf 10. Although FIG. 13 shows six holes and recesses, in a preferred embodiment only a single pair or a single leg is preferred for middle support. Thus, not requiring the six holes and recesses.

As indicated previously the cross-sectional view of FIG. 14 is comprised of a pair of middle legs 32 for providing additional support along a length of the shelving when it is extended. In place of the pair of legs illustrated in FIG. 14, FIG. 15 illustrates a single leg 32 engaged with a hole H in the inner shelf 20. Also illustrated in the perspective view of FIG. 13 are longitudinal axes X and Y. The axis X is meant to represent an axis that goes through the center of each of the respective end ports P. The axis Y represents a center line of the hole H. It is noted that these axes X, Y are separated by a small distance. This can be readily observed by comparing the cross-sectional view of FIG. 7 with the cross-sectional view of FIG. 14.

Figure 16:
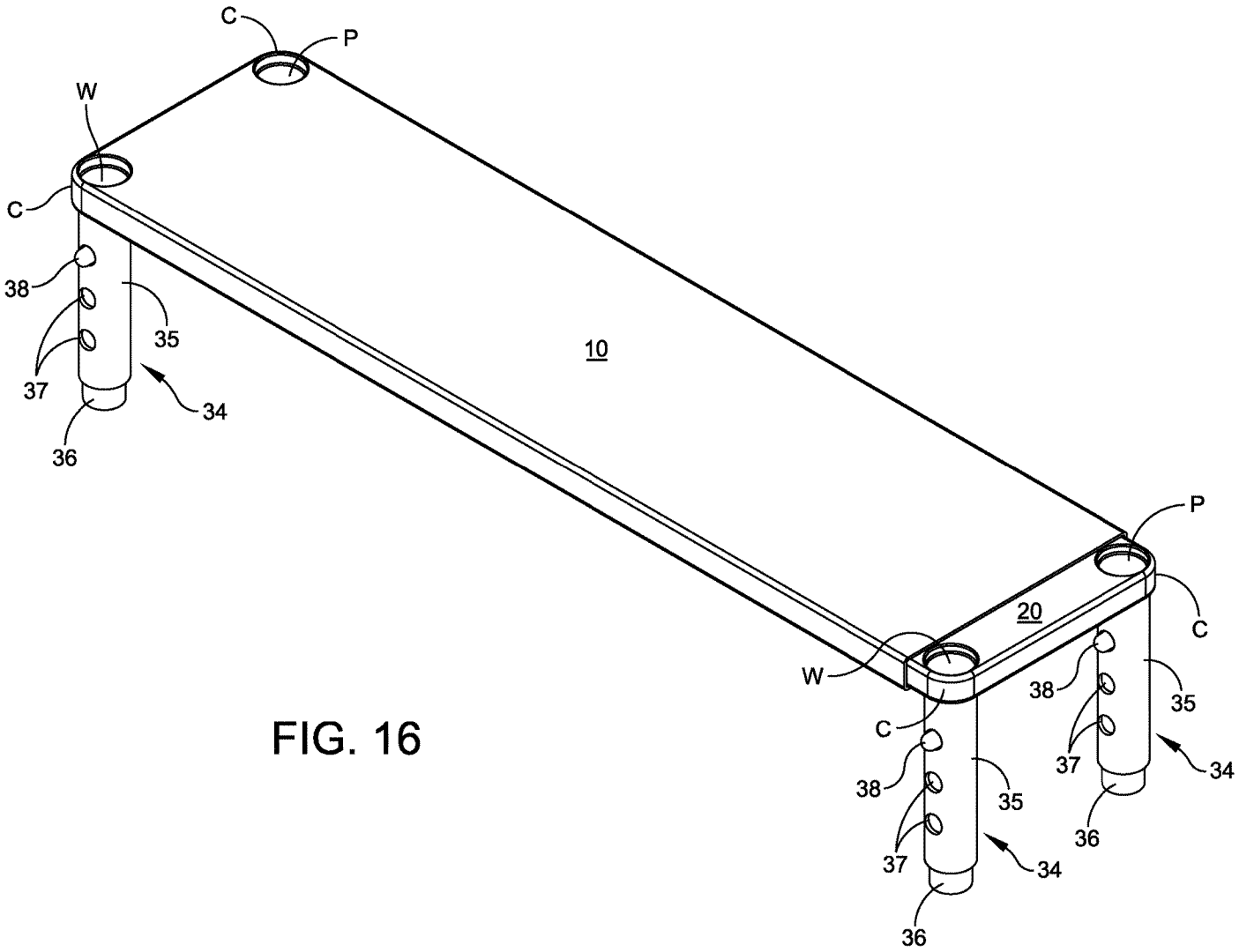
FIG. 16 is a perspective view of still another embodiment of the present invention in which the height of the legs is adjustable.
Figure 20:
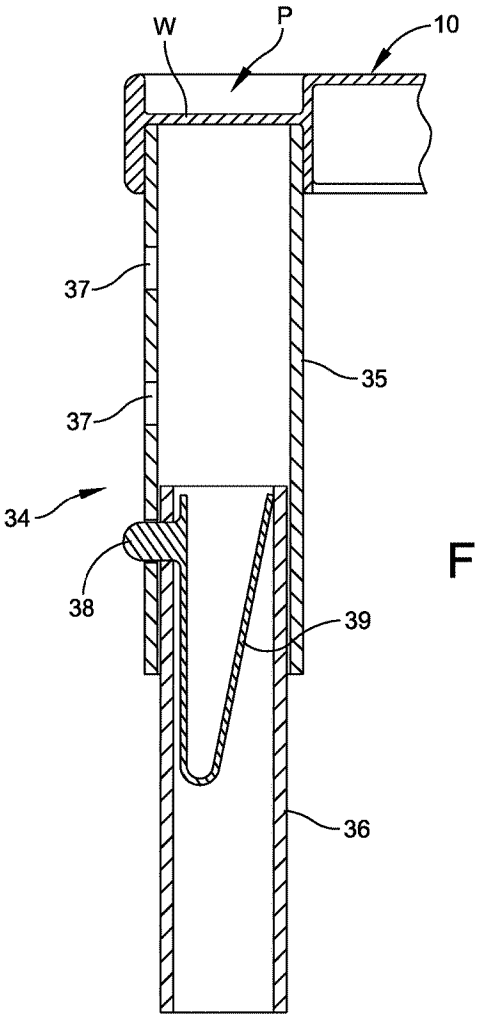
FIG. 20 is a cross-sectional view taken along line 20-20 of FIG. 19.
Figure 19:
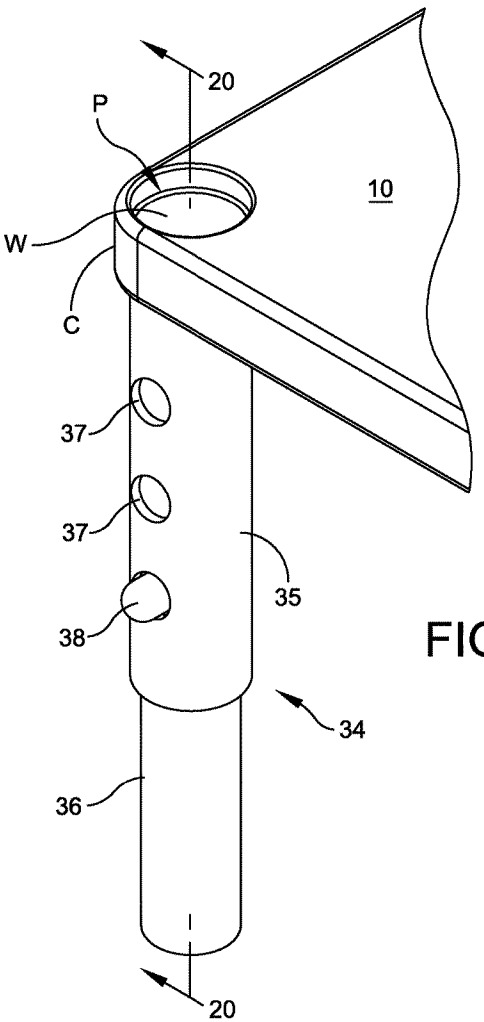
FIG. 19 is a fragmentary perspective view at a corner of the embodiment illustrated in FIG. 16 and showing the legs in a more extended position.
Figure 21:
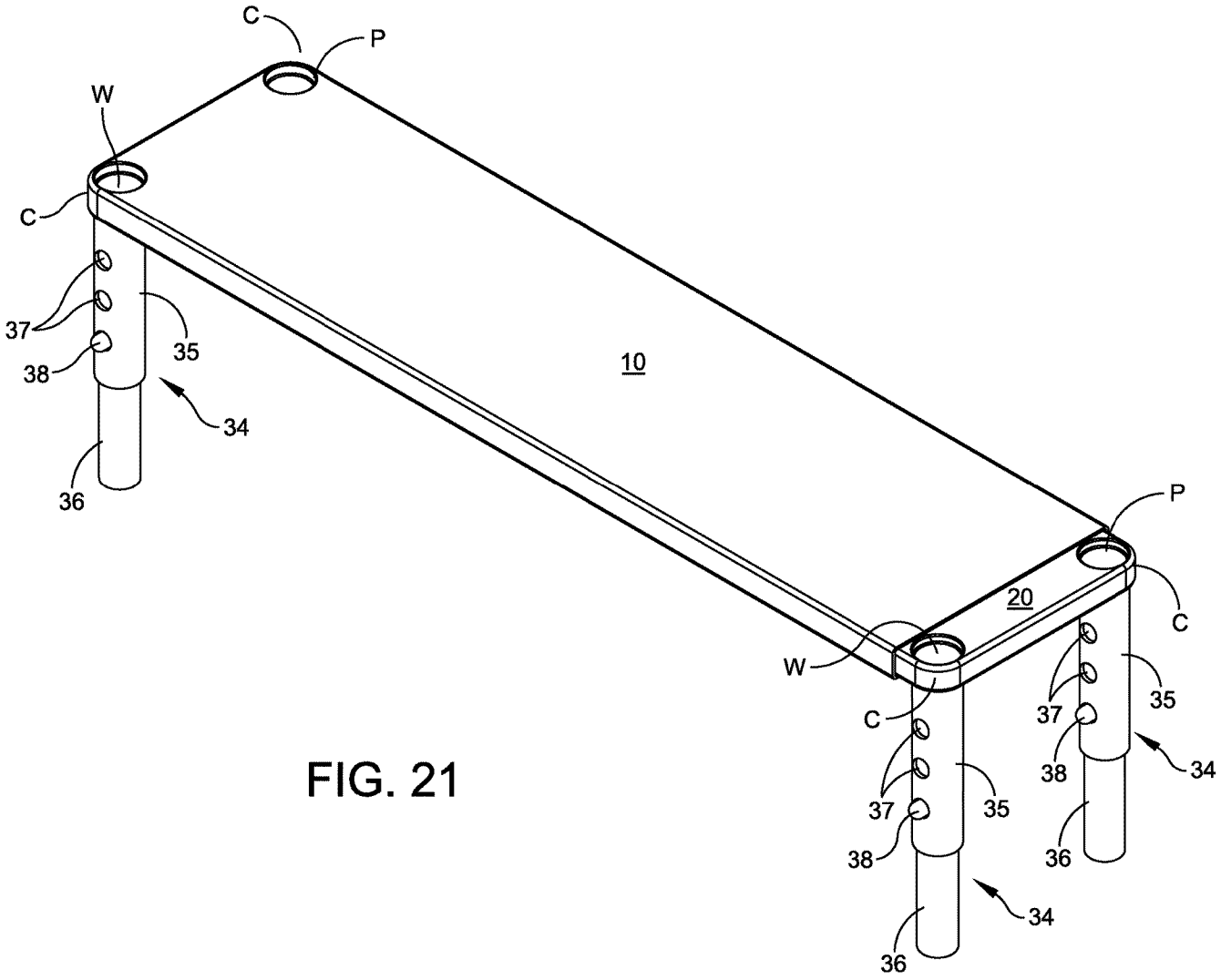
FIG. 21 is perspective view similar to that illustrated in FIG. 16 but with all of the legs moved to a fully extended position.

Reference is now made to FIGS. 16-21 for an illustration of an embodiment that incorporates legs 34 that are adjustable in height. In this regard, FIG. 16 illustrates the legs at a minimum height while FIG. 21 illustrates the legs at a maximum height. It is understood that this adjustable height leg structure may be employed with any of the previously disclosed embodiments in FIGS. 1-15.

Figure 18:
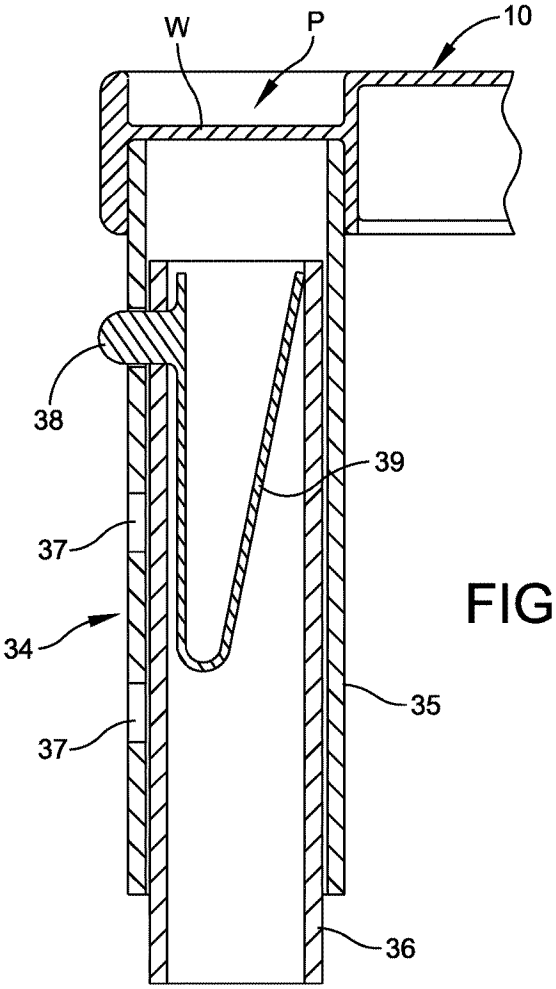
FIG. 18 is a cross-sectional view taken along line 18-18 of FIG. 17.
Figure 17:
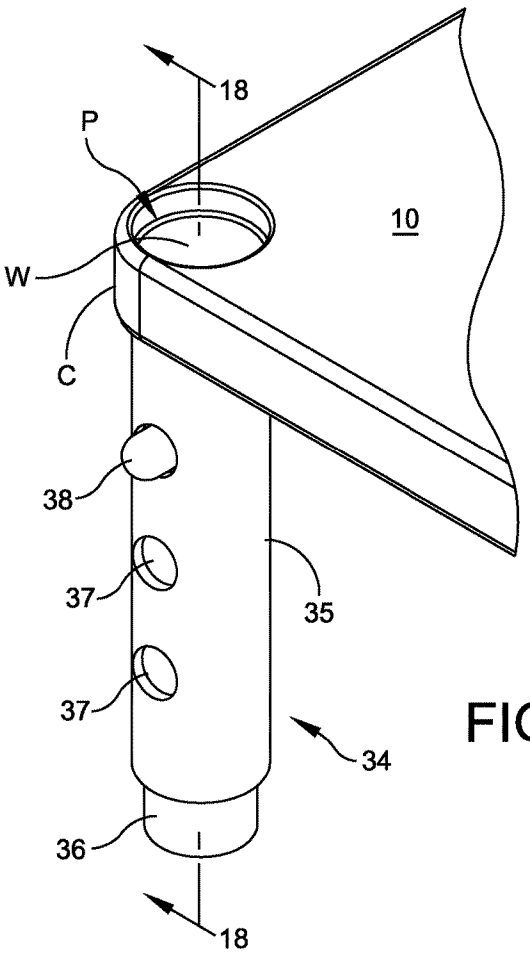
FIG. 17 is an enlarged perspective view at a corner leg in the embodiment of FIG. 16.

Each support leg 34 is comprised of an outer tube 35 and an inner tube 36 that is slidable relative to the outer tube 35. The tubes 35 and 36 are arranged concentric with each other and may be provided with a stop arrangement to limit their fully open position. The cross-sectional views of FIGS. 18-20 clearly illustrate the outer tube 35 and the inner tube 36. The outer tube 35 has a series of holes 37 that are spacedly disposed along a length of the outer tube. In association with these holes, the inner tube 36, such as illustrated in FIGS. 18 and 20, supports a locking button 38 that is for engagement with any one of the holes. FIG. 18 illustrates the button supported from a support spring 39 disposed on the interior of the inner tube 36. The button 38 may be easily depressed by engaging the button manually and moving it manually so it disengages with a hole 37 and then can be moved to a different position. The cross-sectional view of FIG. 20 illustrates where the button 38 is now engaged with a lowermost hole 37 thus providing a fully extended height of each of the legs 34. FIGS. 18 and 20 also illustrate the outer tube 35 engaged within the port of the shelf with the web W resting on the top of the outer tube 35.

Most shelving utilized as shoe racks require considerable space particularly in closets. The purpose of the adjustable shelving of the present invention is to provide a shelving that is readily usable in smaller closets by allowing the flooring to become the first level for shoe storage. The shelving of the present invention provides greater space utilization especially in small closets, condos, apartments or homes. Most other shoe racks take up considerable space, often impeding the ability for accommodating numerous pairs of footwear. In accordance with the present invention there is provided adjustable and stackable shelving that is particularly space-saving for shoes and other items. Existing shelving does not provide all of the features set forth herein and thus does not allow maximum space utilization.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A shoe rack comprising:

a first set of shelves including a first shelf;

a second shelf that slideably interlocks with the first shelf;

a first plurality of support legs including at least two support legs for each of the first shelf and second shelf;

each said first and second shelves having one end that includes a pair of spaced apart receiving ports with each receiving port for accommodating a corresponding support leg therein;

each said first and second shelves further having an opposite end that is leg-free and open so as to be able to have the slideable interlock between the respective first and second shelves;

each shelf having a planar middle portion and opposite side portion with each opposite side portion having a c-shaped cross-section;

said first shelf being wider than the second shelf in order to accommodate an engagement and sliding between the shelves;

each receiving port being disposed at a corner of the shelf and being sized to receive a top of the support leg;

each of the first and second shelves having spaced apart support corners, and the plurality of legs comprise four legs, one engaged with the receiving port that is disposed at each corner of the respective first and second shelves;

the first and second shelves having a closed position wherein a total length of the first and second shelves is at a minimum length and an extended position wherein the total length of the first and second shelves is longer than the minimum length;

said four legs of the first plurality of support legs comprised of a first pair of spaced apart legs at the one end of the first shelf and a second pair of spaced apart legs at the one end of the second shelf;

at least one lower intermediate leg for support of the first and second shelves at a location between the respective first and second pairs of spaced apart legs and when the shelves are in the extended position;

the second shelf having at least one hole for receiving a top end of the at least one lower intermediate leg;

a second set of shelves including a third shelf and a fourth shelf that slideably interlocks with the third shelf;

a second plurality of legs for the support of the second set of shelves over the first set of shelves;

said second plurality of legs comprised of a third pair of spaced apart legs for support of the third shelf and a fourth pair of spaced apart legs for support of the fourth shelf;

at least one upper intermediate leg for support of the third and fourth shelves at a location over the first and second shelves and between the respective third and fourth pairs of spaced apart legs;

said first shelf having a blind recess in a top surface thereof and for receiving a bottom end of the upper intermediate leg;

said receiving ports including side disposed ports that extend along a longitudinal axis X that extends through a center of the side disposed ports;

said holes for receiving a top end of the at least one intermediate leg extending along a longitudinal axis Y that extends through a center of the hole;

the axis Y is disposed spaced inward of and parallel to the axis X so that the intermediate legs extend clear of interference with the side portion having a c-shaped cross-section.

2. The shoe rack of claim 1 including a pair of lower intermediate legs that are spaced apart.

3. The shoe rack of claim 2 including a pair of upper intermediate legs that are spaced apart.

4. The shoe rack of claim 3 wherein each of the upper intermediate legs is in linear alignment with and overlying a corresponding lower intermediate leg.

5. The shoe rack of claim 4 wherein each lower intermediate leg is disposed clear of interference with but adjacent to a side portion of c-shaped cross-section.

6. The shoe rack of claim 1 including a series of blind recesses in a top surface of the first shelf that are spaced apart and that extend along the Y axis.

7. The rack of claim 1 wherein each support leg is comprised of an outer tube and an inner tube that is slideable relative to, concentric, and disposed within the outer tube.

8. The rack of claim 7 wherein the outer tube has a series of holes spacedly disposed along a length of the outer tube, and the inner tube supports a locking button for engagement with any one of the holes in order to adjust the height of the leg.

* * * * *